US008822852B2

(12) United States Patent
Ho et al.

(10) Patent No.: US 8,822,852 B2
(45) Date of Patent: Sep. 2, 2014

(54) MULTI-LEVEL ROTARY SWITCH

(71) Applicant: Solteam Electronics Co., Ltd., Taoyuan (TW)

(72) Inventors: Ying-Sung Ho, Taoyuan (TW); Chen-Hong Huang, Taoyuan (TW); Chang-Nan Chen, Taoyuan (TW); Hung-Ju Wei, Taoyuan (TW); Chen-Wei Lai, Taoyuan (TW); Tao-Lung Hsueh, Taoyuan (TW)

(73) Assignee: Solteam Electronics Co., Ltd. (TW)

( * ) Notice: Subject to any disclaimer, the term of this patent is extended or adjusted under 35 U.S.C. 154(b) by 101 days.

(21) Appl. No.: 13/675,057

(22) Filed: Nov. 13, 2012

(65) Prior Publication Data

US 2014/0131179 A1 May 15, 2014

(51) Int. Cl.

| | |
|---|---|
| ***H01H 19/10*** | (2006.01) |
| ***H01H 19/14*** | (2006.01) |
| ***H01H 19/11*** | (2006.01) |
| *H01H 19/46* | (2006.01) |

(52) U.S. Cl.

CPC ..... *H01H 19/14* (2013.01); *H01H 19/11* (2013.01); *H01H 19/46* (2013.01)

USPC ..... 200/11 J; 200/570

(58) Field of Classification Search

CPC ..... H01H 19/38; H01H 19/48; H01H 19/10; H01H 19/14; H01H 19/03

USPC ..... 200/11 R, 11 J, 11 A, 564, 570, 571, 336

See application file for complete search history.

(56) References Cited

U.S. PATENT DOCUMENTS

| | | | | |
|---|---|---|---|---|
| 3,927,288 | A * | 12/1975 | Utken et al. | 200/564 |
| 5,606,155 | A * | 2/1997 | Garcia | 200/11 R |
| 5,680,927 | A * | 10/1997 | Thornton | 200/565 |
| 6,143,994 | A * | 11/2000 | Thivilier | 200/11 R |
| 6,610,938 | B2 * | 8/2003 | Funfer | 200/11 R |
| 8,076,603 | B2 * | 12/2011 | Huang et al. | 200/566 |

* cited by examiner

*Primary Examiner* — Felix O Figueroa

(57) ABSTRACT

A rotary switch with multi-level is disclosed. The rotary switch includes a rotary base that drives the first conductive sheet to rotate with the second conductive sheet when the rotary shaft is rotated, and the second conductive sheet leaves one of the conductive contact elements; the position end of the second conductive sheet is pressed by one positioning surface during the rotation, and the second spring stores energy; the second spring then releases the energy to the fourth end of the second conductive sheet, and the position end of the second conductive sheet slides on one positioning surface until the position end of the second conductive sheets is positioned solidly between two positioning surfaces; so that, the material cost in production can be lower down, and life time of the rotary switch can be increased.

5 Claims, 16 Drawing Sheets

5

5

7

MULTI-LEVEL ROTARY SWITCH

BACKGROUND OF THE INVENTION

1. Technical Field

The present invention relates to multi-level rotary switch, and more particularly, to a switch device able to be applied in various family electrical products with less electrical contact points, and increase durability by adjusting the pressure between the electrical contact points.

2. Description of Related Art

Switch is a necessary device in general electrical products, like machine tools and family electrical products, mostly used to control the electrical product to start and stop, or adjusting intensity of output circuit. Button switch and rotary switch are most general type of switch device. The button switch is mostly designed for simply controlling the electrical product to start and stop, and is rarely designed for adjusting intensity of output circuit. On the other hand, the rotary switch is mostly designed for adjusting intensity of output circuit. The intensity of output circuit can be adjusted by two general forms including controlling variable resistor and switching contact points.

Please refer to FIG. 1, shown an exploded view of conventional rotary switch. As shown in FIG. 1, a conventional rotary switch includes a rotary member 30P, a switch sheet 40P, and a main plate 50P, the rotary member 30P has a first spinning portion 31P on one side and a second spinning portion 32P on the other; the switch sheet 40P has a first conductive portion 41P, a second conductive portion 42P and a third conductive portion 43P, wherein the first conductive portion 41P locates on central of the switch sheet 40P, the second conductive portion 42P locates on one side of the switch sheet 40P and the third conductive portion 43P locates on the other. A first pivoting 44P is formed at the first conductive portion 41P, and providing the second spinning portion 32P to pass through, thus, the switch sheet 40P is able to position on the rotary member 30P. A second pivoting 51P is formed at central of the main plate 50P, and providing the second spinning portion 32P to pass through, thus, the second spinning portion 32P of the rotary member 30P is able to pivot on the main plate 50P with the switch sheet 40P. The main plate 50P further includes a main conductive unit 52P, a first conductive unit 53P, a second conductive unit 54P, a third conductive unit 55P and a fourth conductive unit 56P, wherein the main conductive unit 52P is made by conductive material, and disposed around the second pivoting 51P of the main plate 50P, thus, the switch sheet 40P contacts with the main conductive unit 52P when the second spinning portion 32P of the rotary member 30P pivots on the main plate 50P. The first conductive unit 53P, the second conductive unit 54P, the third conductive unit 55P and the fourth conductive unit 56P are all rectangle and made by conductive material, moreover, the first conductive unit 53P, the second conductive unit 54P, the third conductive unit 55P and the fourth conductive unit 56P are disposed on the main plate 50P.

The second conductive unit 54P is disposed between the first conductive unit 53P and the third conductive unit 55P, and opposite to the fourth conductive unit 56P. Due to the switch sheet 40P is restricted by the second spinning portion 32P of the rotary member 30P, the rotary member 30P pivots on the main plate 50P with the switch sheet 40P when the first spinning portion 31P of the rotary member 30P is rotated. During the rotation, the first conductive portion 41P of the switch sheet 40P keeps conducting to the main conductive unit 52P. The second conductive portion 42P of the switch sheet 40P conducts optionally to the first conductive unit 53P, the second conductive unit 54P and the third conductive unit 55P.

So that, through above descriptions, it is able to know that the constituting elements and the structure thereof of the conventional rotary switch, for more detail, switching of the conventional rotary switch also need to be introduced. During the switching of the conventional rotary switch, the first conductive portion 41P keeps conducting to the main conductive unit 52P, and the second conductive portion 42P of the switch sheet 40P conducts optionally to the first conductive unit 53P, the second conductive unit 54P and the third conductive unit 55P, that means, the switching of the conventional rotary switch needs at least four contact points to switch in each switch level. Please refer to FIG. 2A, shown a first switch level of the conventional rotary switch. The first conductive portion 41P conducts to the main conductive unit 52P, and the second conductive portion 42P conducts to the first conductive unit 53P, thus, the circuit supplied by AC power supplier only runs through first circuit A1, also, four contact points are used in first switch level of the conventional rotary switch including the first conductive portion 41P, the main conductive unit 52P, the second conductive portion 42P, the first conductive unit 53P. Please refer to FIG. 2B, shown a second switch level of the conventional rotary switch. The first conductive portion 41P conducts to the main conductive unit 52P, the second conductive portion 42P conducts to the second conductive unit 54P, and the third conductive portion 43P conducts to the fourth conductive unit 56P, thus, the circuit supplied by AC power supplier runs through first circuit A1 and second circuit A2, also, six contact points are used in second switch level of the conventional rotary switch. Obviously, the conventional rotary switch requests at least four contact points to operate. Under this request, it is clearly to know the first circuit A1 or the second circuit A2 cannot work normal if one contact point fails by worn, so the conventional rotary switch cannot be operate.

Moreover, the first conductive portion 41P and the second conductive portion 42P easily fail from fatigue after the conventional rotary switch is operated for a period, thus, the switch sheet 40P lost contact to the main plate 50P, and the switch sheet 40P cannot conduct to the main plate 50P if contact is lost, as the result, the conventional rotary switch cannot operate.

Accordingly, in view of the conventional rotary switch still has shortcomings and drawbacks, the inventor of the present application has made great efforts to make inventive research thereon and eventually provided a multi-level rotary switch.

BRIEF SUMMARY OF THE INVENTION

The primary objective of the present invention is to provide a multi-level rotary switch, in which, the present invention uses three contact points in three-level rotary switch, and only adds one contact point in each level of the rotary switch increasing, so that, the material cost in production can be lower down, and life time of the rotary switch can be increased.

Accordingly, to achieve the above objectives of the present invention, the inventor proposes a multi-level rotary switch, comprising a loading housing, having an accommodating space, and a first inserting hole being formed below the accommodating space with a plurality of second inserting holes; a plurality of contact elements, being connected with any circuit, and further comprising: a main contact element, having a first end and a second end, wherein the first end is located and flatted in the accommodating space, and the second end passes through the first inserting hole of the loading housing; a plurality of conductive contact element, passing through the second inserting holes of the loading housing; wherein each conductive contact element has a third end; wherein the third end is in the accommodating space with one conductive element; a first conductive sheet, having an inserting end, a first pressing portion, a second pressing portion and a sheet accommodating opening; wherein the first pressing portion is between the inserting end and the second pressing portion, and disposed on the first end of the main contact element; wherein the sheet accommodating opening is located at the second pressing portion with a piercing unit; a second conductive sheet, having a position end, a piercing hole, a fourth end; wherein the position end with curved shape passes through and locates above the sheet accommodating opening; the piercing hole is between the position end and the fourth end, and is inserted by the piercing unit, so that, the second conductive sheet is locked with the first conductive sheet; wherein the fourth end has one conductive element, and contacts with at least one conductive element disposed on the third end of the conductive contact element.

The multi-level rotary switch also comprises a rotary body, including a rotary base, having an elastic element accommodating slot and an inserting slot, wherein the inserting end of the first conductive sheet inserts into the inserting slot; and a rotary shaft, being disposed on the rotary base; a first spring, being located in the elastic element accommodating slot, and leaning against the first pressing portion of the first conductive sheet, thus, the first pressing portion pressing on the first end of the main contact element; a second spring, leaning against the second pressing portion of the first conductive sheet and the fourth end of the second conductive sheet, thus, the fourth end of the second conductive sheet contacting with the first end of the main contact element; and a cover, being able to combine with the loading housing, having a rotary body accommodating space and a plurality of positioning surfaces; wherein the rotary body passes through the rotary body accommodating space and protrudes out of the cover, thus, the rotary shaft can be operated properly; wherein the positioning surfaces are formed at lower cover, and the position end of the second conductive sheet is able to fit the positioning surfaces, so that the second conductive sheet connected with the first conductive sheet is able to be positioned.

In the present invention, the rotary base drives the first conductive sheet to rotate with the second conductive sheet when the rotary shaft is rotated, and the second conductive sheet leaves one of the conductive contact elements; the position end of the second conductive sheet is pressed by one positioning surface during the rotation, and the second spring stores energy; the second spring then releases the energy to the fourth end of the second conductive sheet, and the position end of the second conductive sheet slides on one positioning surface until the position end of the second conductive sheets is positioned solidly between two positioning surfaces.

The loading housing also has a plurality of first locking element, and the cover has a plurality of second locking element. The first locking element locks the second locking element when the loading housing connects with the cover. Since silver has the highest electrical conductivity, the silver is widely used in electrical contacts and conductors. The conductive element according to the present invention is disposed on the third end of the conductive contact element and the fourth end of the second conductive sheet, and is made by silver. Each conductive element represents one contact point, in the present invention, the rotary switch only used two contact points in one level, used three contact points in two levels, and used four contact points in three levels.

BRIEF DESCRIPTION OF THE SEVERAL VIEWS OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE INVENTION

Figure 1:
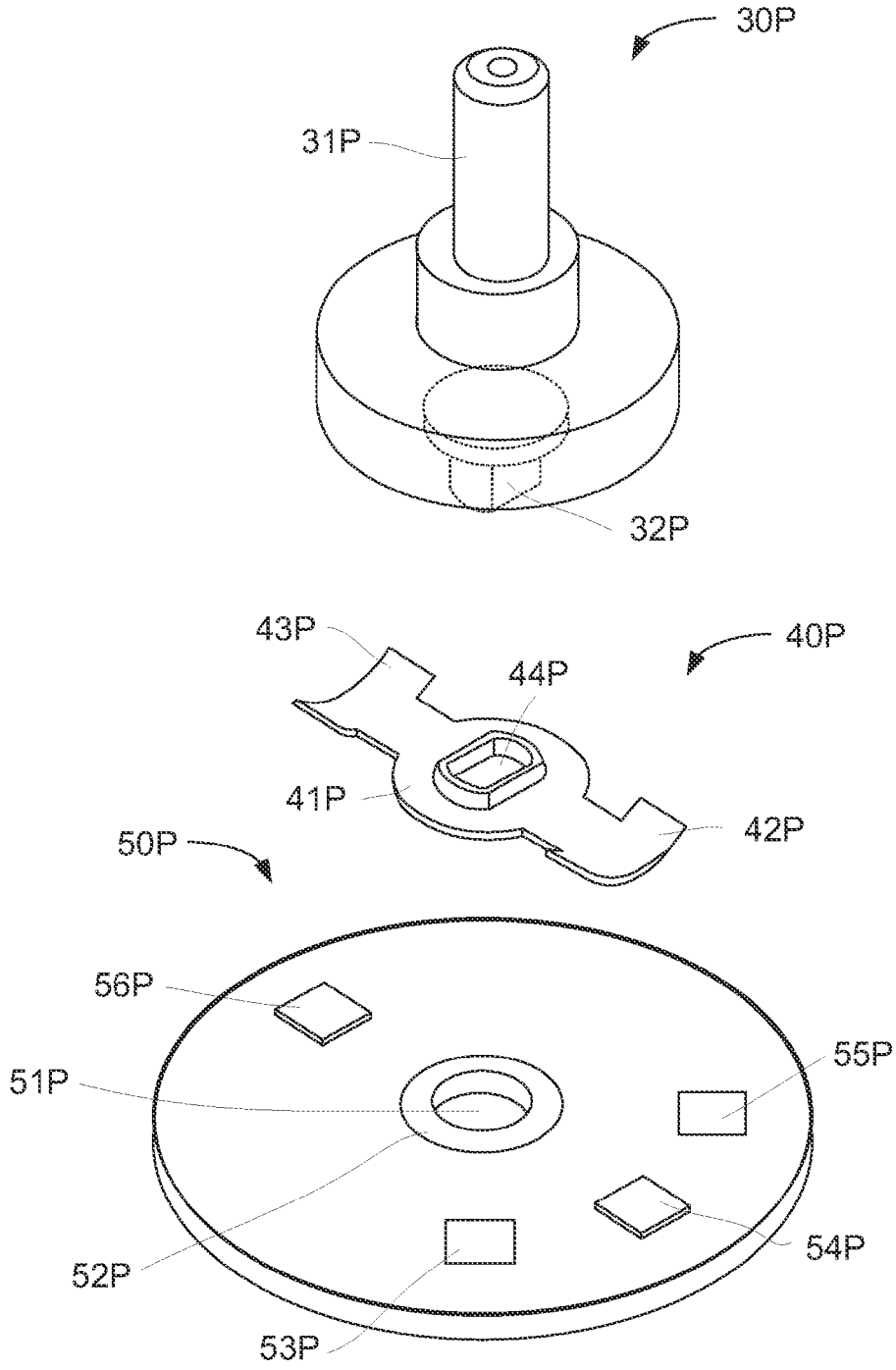
FIG. 1 (PRIOR ART)
FIG. 1 is an exploded view of conventional rotary switch.
Figure 2A:
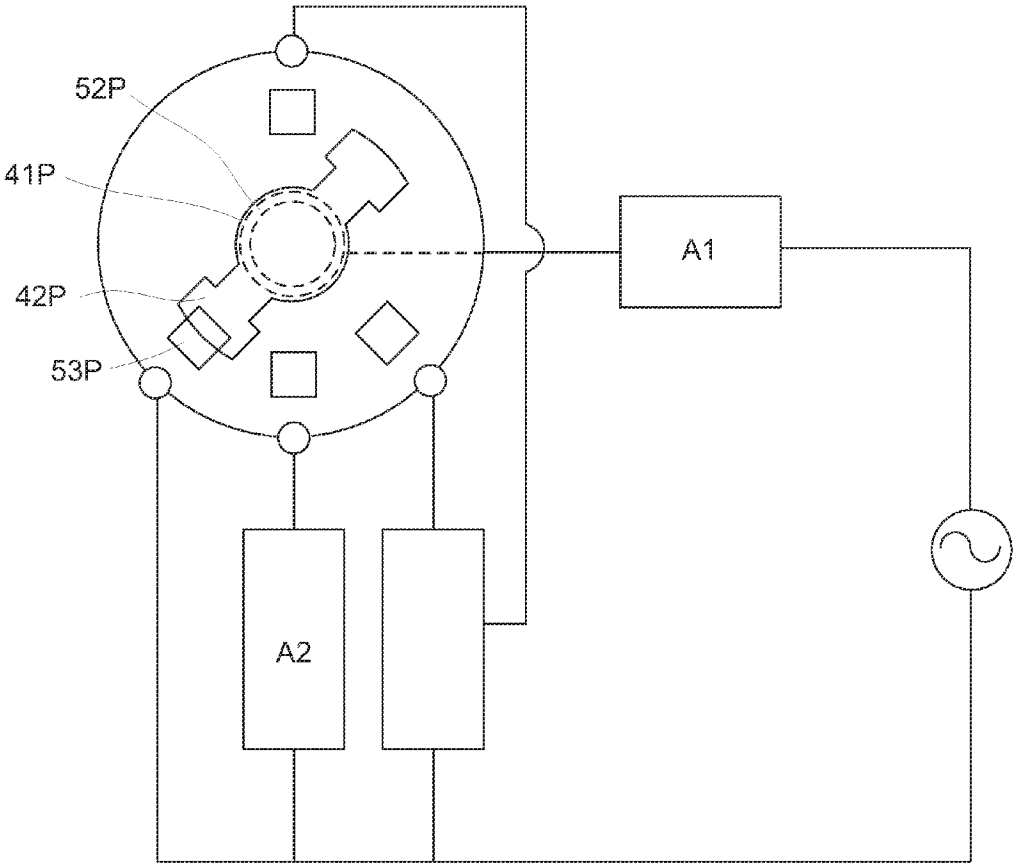
FIG. 2A (PRIOR ART)
FIG. 2A demonstrates first switch level of the conventional rotary switch.
Figure 2B:
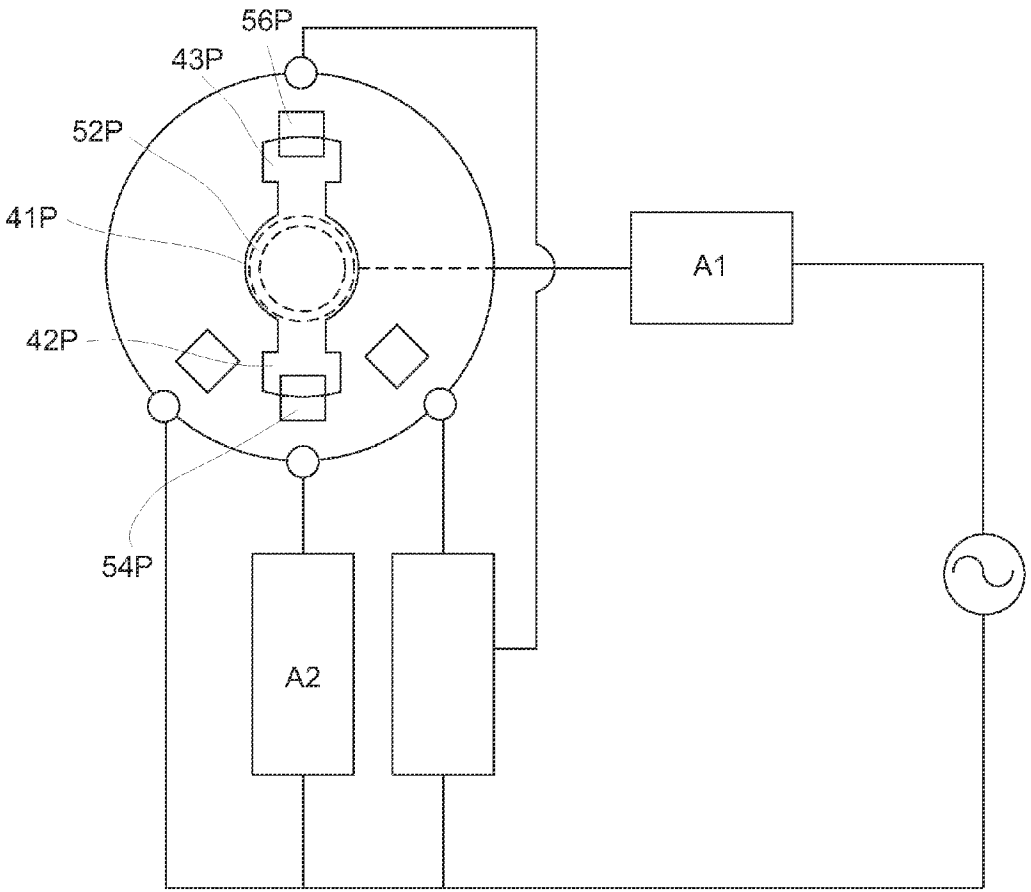
FIG. 2B (PRIOR ART)
FIG. 2B demonstrates second switch level of the conventional rotary switch.
Figure 3:
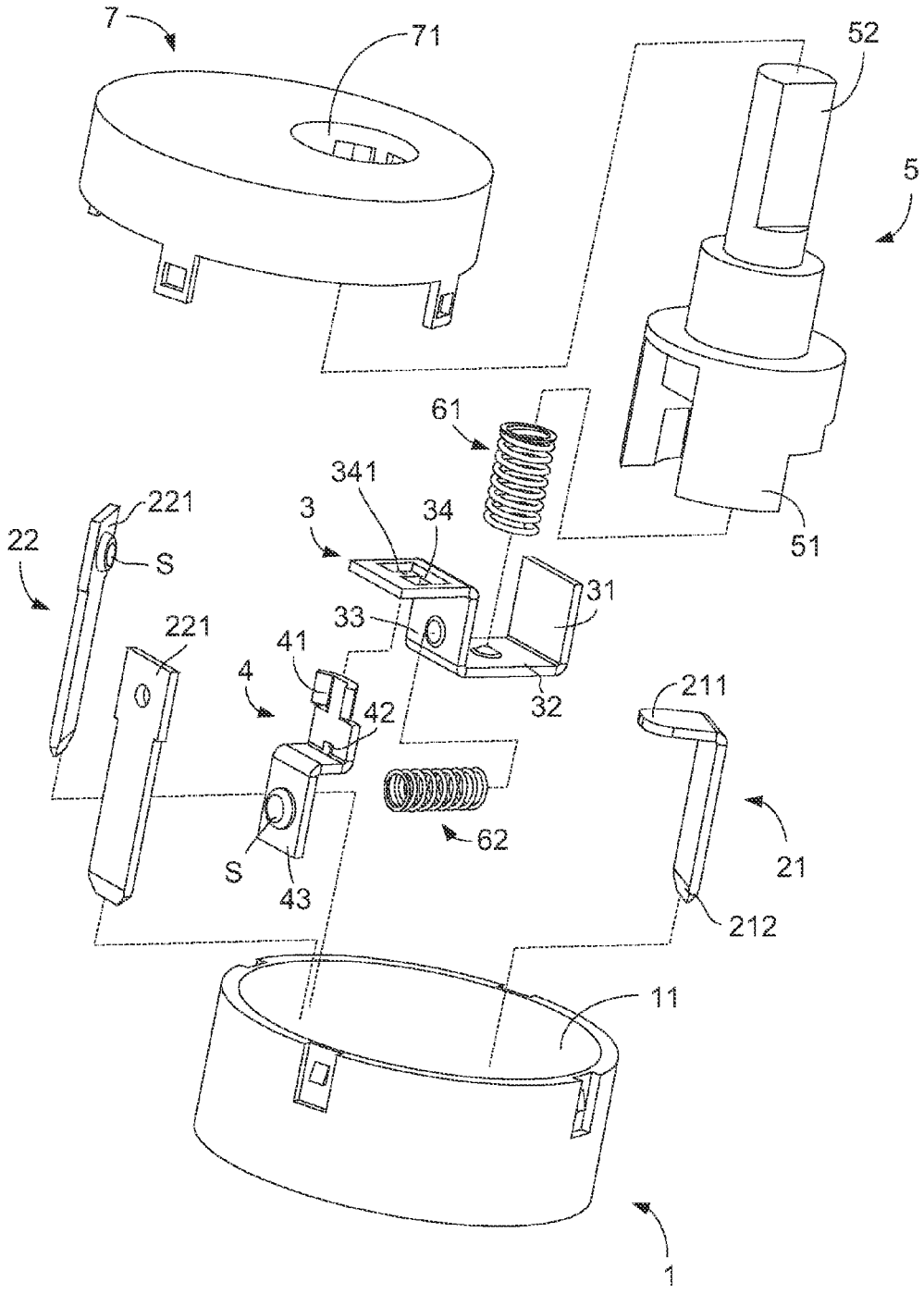
FIG. 3 is an exploded view of the multi-level rotary switch according to the present invention.
Figure 4:
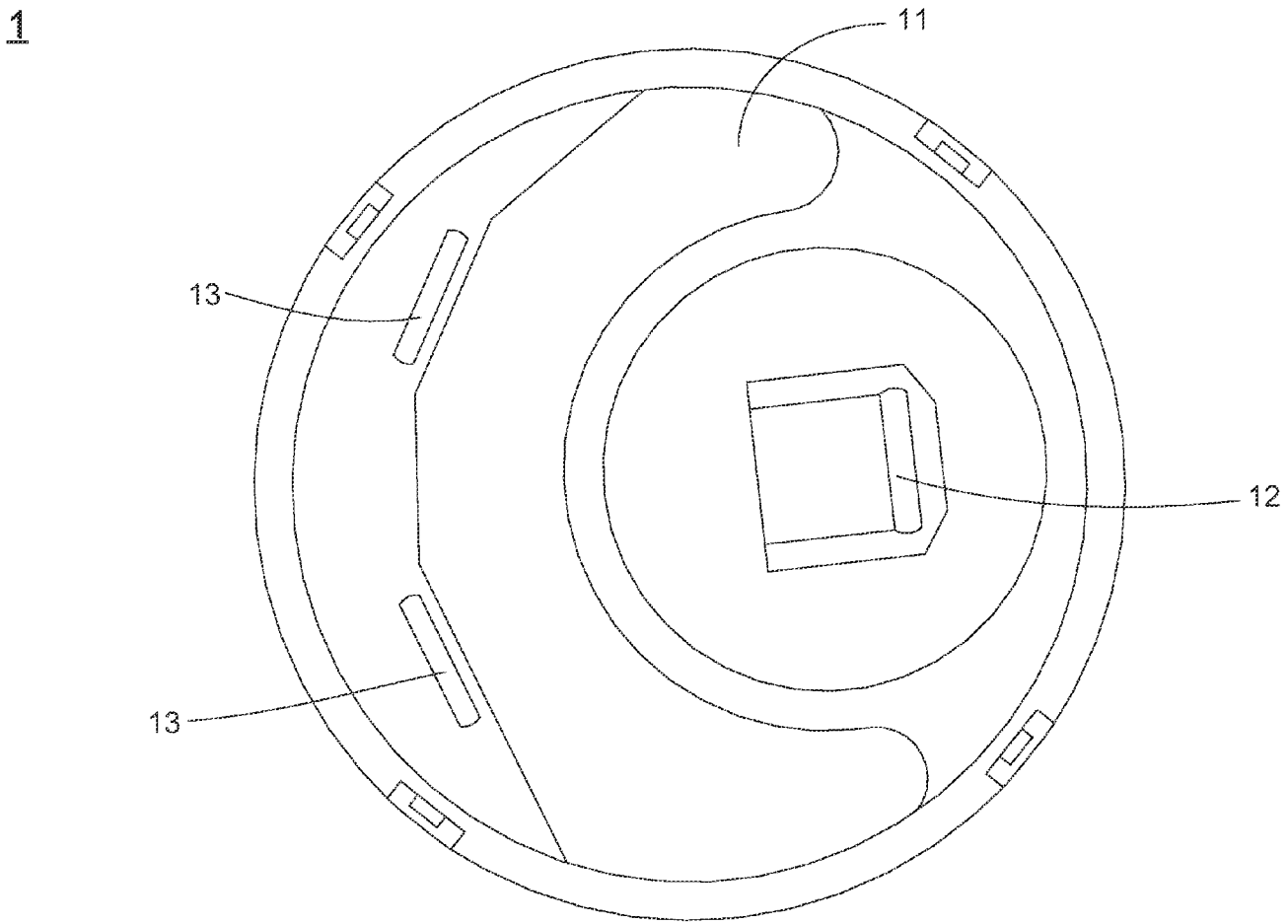
FIG. 4 is a top plan view of the loading housing according to the present invention.

To more clearly describe a multi-level rotary switch according to the present invention, embodiments of the present invention will be described in detail with reference to the attached drawings hereinafter.

Please refer to FIG. 3 to FIG. 6, there are shown an exploded view of the multi-level rotary switch according to the present invention, a top plan view of the loading housing according to the present invention, a stereo view of the rotary body according to the present invention, and a bottom plan view of the cover according to the present invention, respectively. The present invention is a multi-level rotary switch, which comprises a loading housing 1, having an accommodating space 11, and a first inserting hole 12 being formed below the accommodating space 11 with a plurality of second inserting holes 13; a plurality of contact elements, being connected with any circuit, and further comprising: a main contact element 21, having a first end 211 and a second end 212, wherein the first end 211 is located and flatted in the accommodating space 11, and the second end 212 passes through the first inserting hole 12 of the loading housing 1; a plurality of conductive contact element 22, passing through the second inserting holes 13 of the loading housing 1; wherein each conductive contact element 22 has a third end 221; wherein the third end 221 is in the accommodating space 11 with one conductive element S; a first conductive sheet 3, having an inserting end 31, a first pressing portion 32, a second pressing portion 33 and a sheet accommodating opening 34; wherein the first pressing portion 32 is between the inserting end 31 and the second pressing portion 33, and disposed on the first end 211 of the main contact element 21;

wherein the sheet accommodating opening 34 is located at the second pressing portion 33 with a piercing unit 341; a second conductive sheet 4, having a position end 41, a piercing hole 42, a fourth end 43; wherein the position end 41 with curved shape passes through and locates above the sheet accommodating opening 34; the piercing hole 42 is between the position end 41 and the fourth end 43, and is inserted by the piercing unit 341, so that, the second conductive sheet 4 is locked with the first conductive sheet 3; wherein the fourth end 43 has one conductive element S, and contacts with at least one conductive element S disposed on the third end 221 of the conductive contact element 22.

Figure 5A:
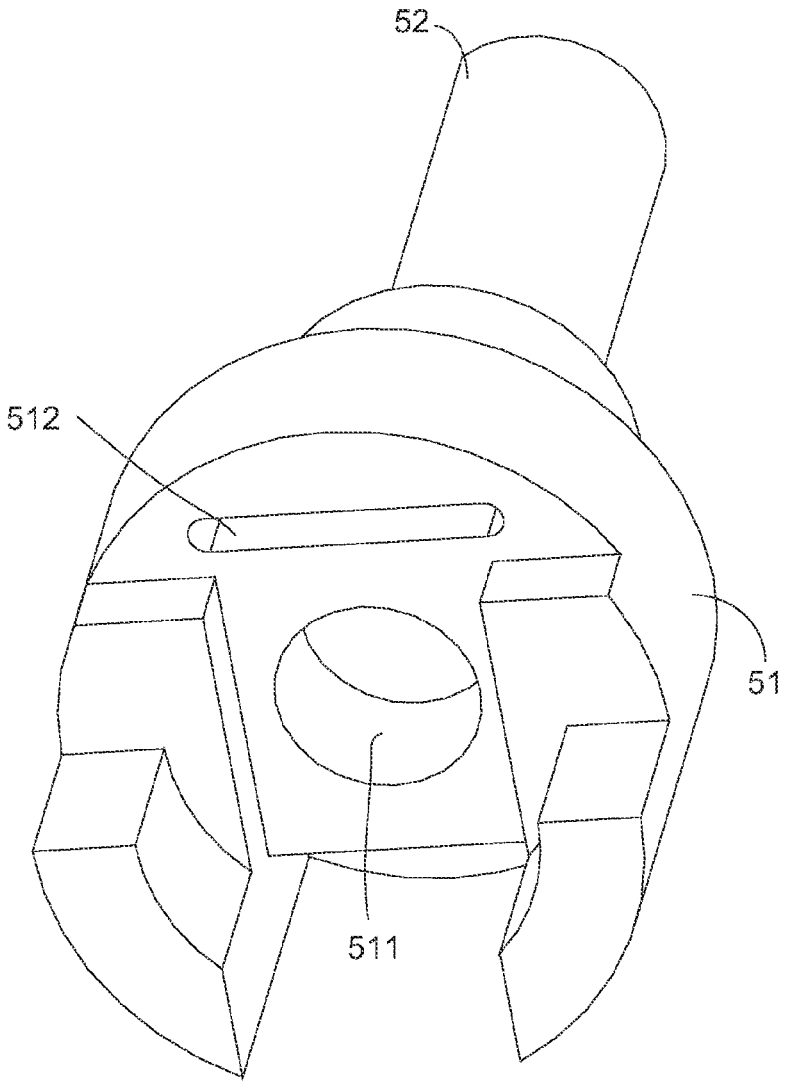
FIGS. 5A and 5B are stereo view of the rotary body according to the present invention.
Figure 5B:
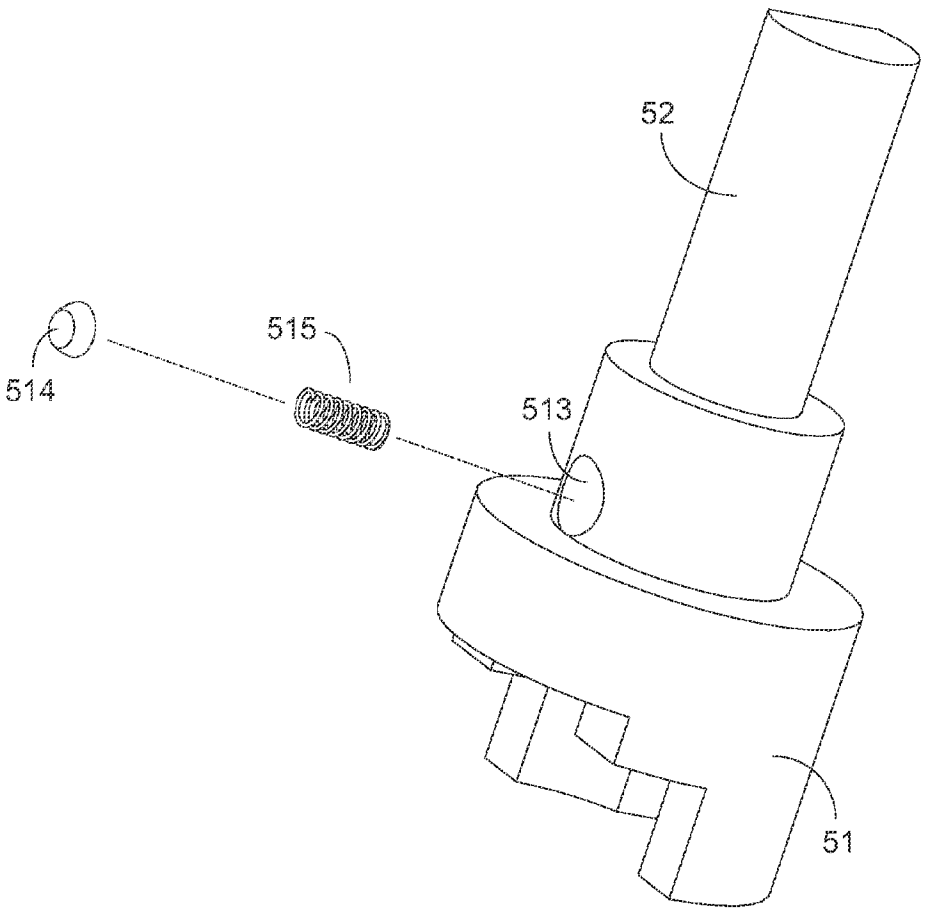
Figure 6:
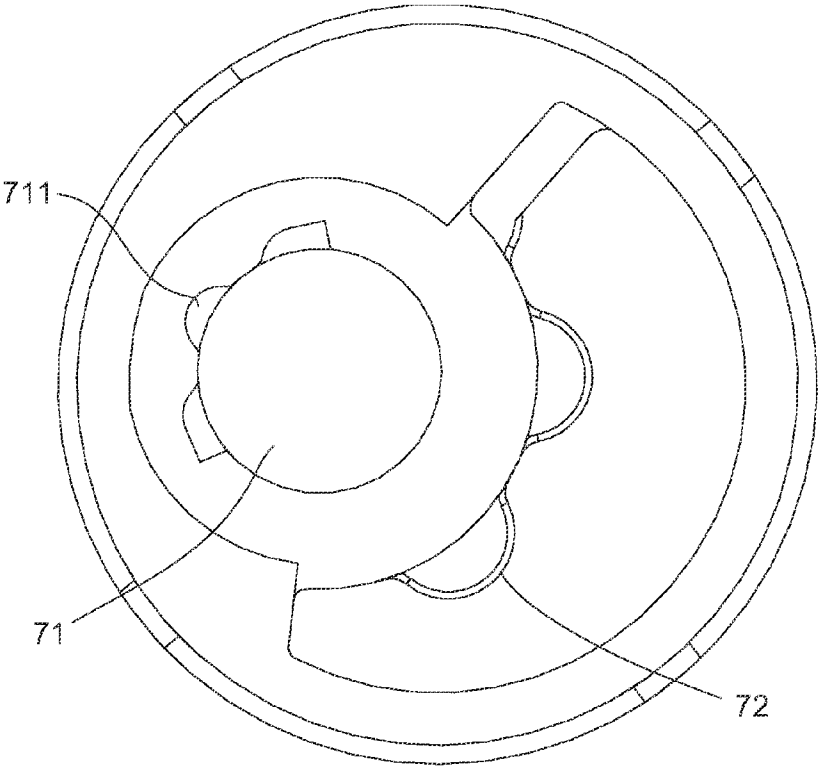
FIG. 6 is a bottom plan view of the cover according to the present invention.
Figure 7:
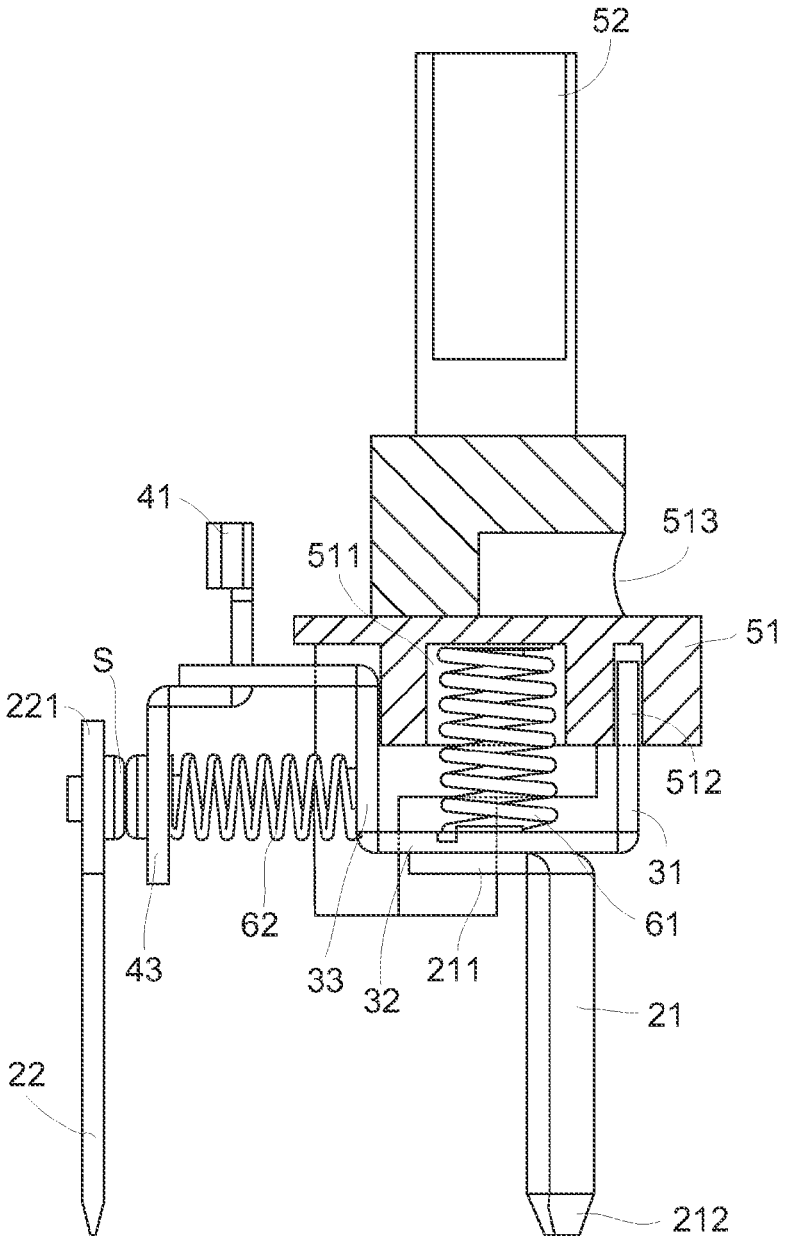
FIG. 7 is a sectional view of the rotary base according the present invention.

Please refer to FIG. 7, shown a sectional view of the rotary base according the present invention, also refer to FIGS. 3 to 6. The multi-level rotary switch also comprises a rotary body 5, including a rotary base 51, having an elastic element accommodating slot 511 and an inserting slot 512, wherein the inserting end 31 of the first conductive sheet 3 inserts into the inserting slot 512; and a rotary shaft 52, being disposed on the rotary base 51; a first spring 61, being located in the elastic element accommodating slot 511, and leaning against the first pressing portion 32 of the first conductive sheet 3, thus, the first pressing portion 32 pressing on the first end 211 of the main contact element 21; a second spring 62, leaning against the second pressing portion 33 of the first conductive sheet 3 and the fourth end 43 of the second conductive sheet 4, thus, the fourth end 43 of the second conductive sheet 4 contacting with the first end 211 of the main contact element 21; and a cover 7, being able to combine with the loading housing 1, having a rotary body accommodating space 71 and a plurality of positioning surfaces 72; wherein the rotary body 5 passes through the rotary body accommodating space 71 and protrudes out of the cover 7, thus, the rotary shaft 52 can be operated properly; wherein the positioning surfaces 72 are formed at lower cover 7, and the position end 41 of the second conductive sheet 4 is able to fit the positioning surfaces 72, so that the second conductive sheet 4 connected with the first conductive sheet 3 is able to be positioned.

Figure 8A:
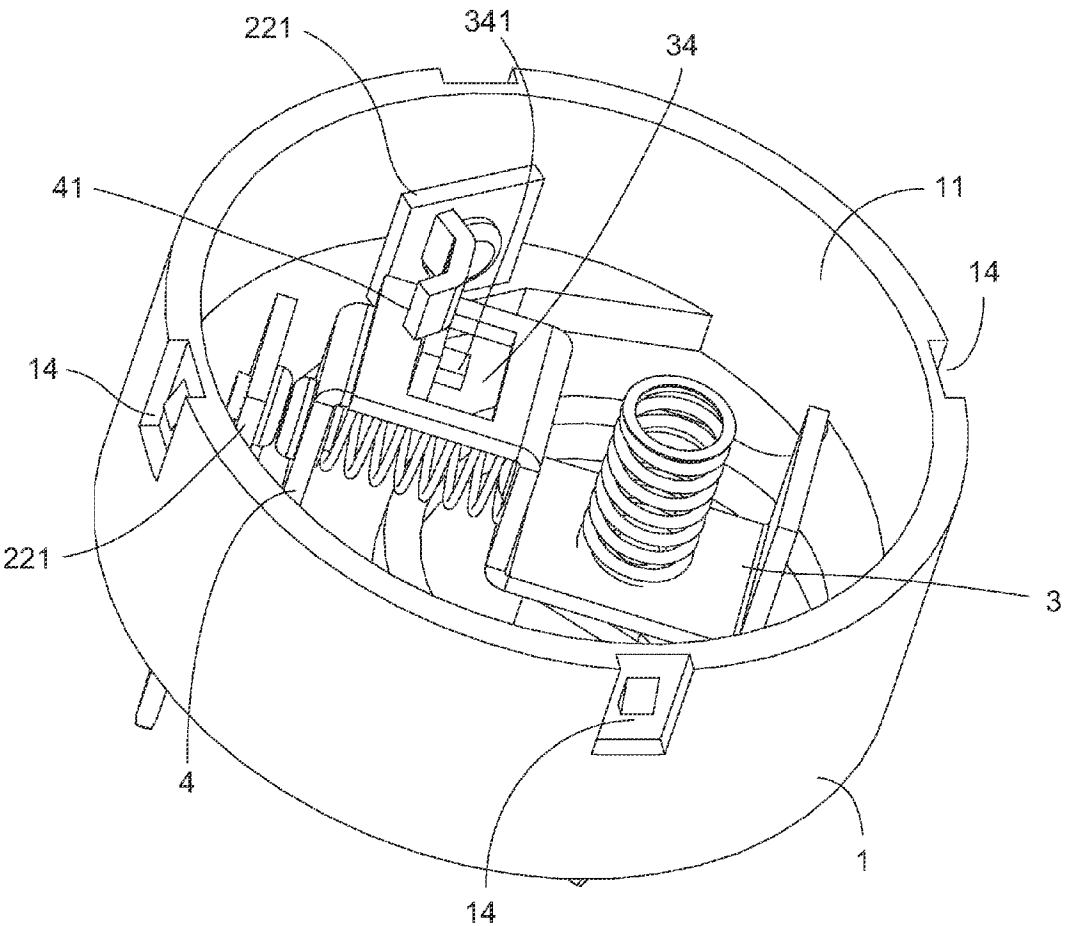
FIG. 8A demonstrates the second conductive sheet contacts with the conductive contact element in loading housing according to the present invention.
Figure 8B:
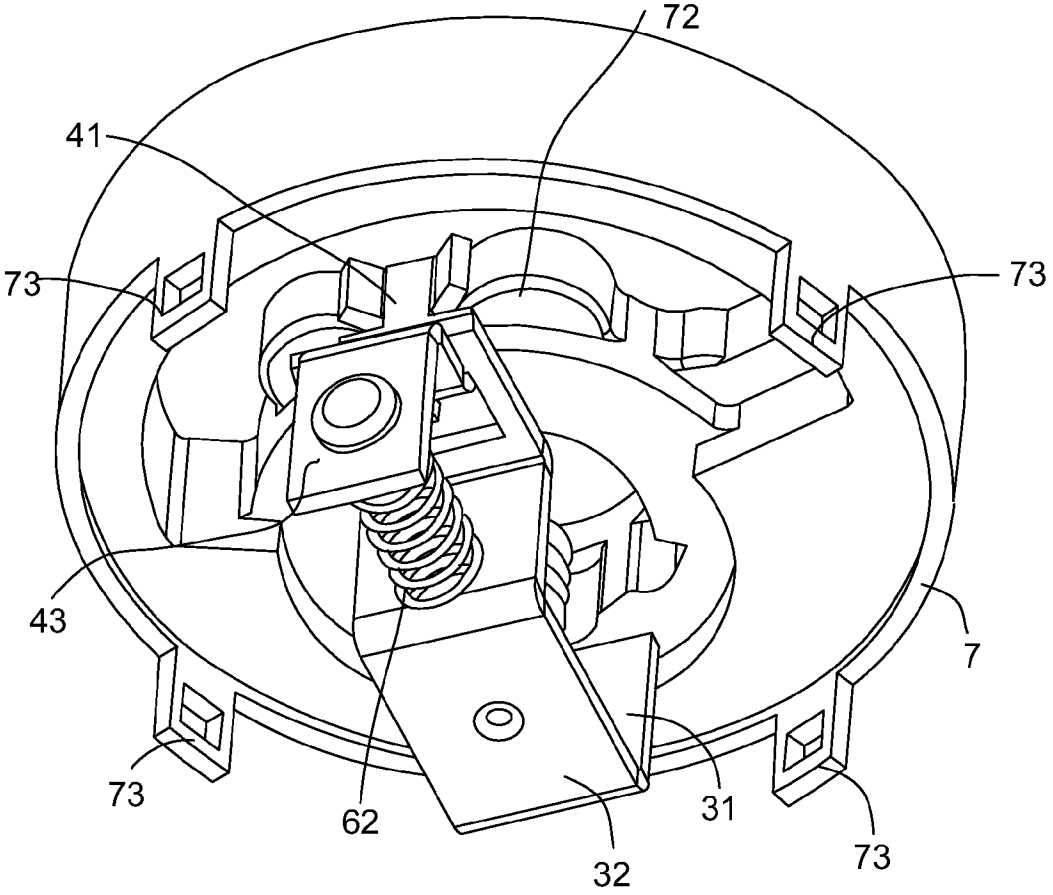
FIG. 8B demonstrates the position end of second conductive sheet positioned between positioning surfaces in the cover according to the present invention.

Next, please refer to FIGS. 7, 8A and 8B, wherein the FIG. 8A demonstrates the second conductive sheet contacts with the conductive contact element in loading housing according to the present invention, and the FIG. 8B demonstrates the position end of second conductive sheet positioned between positioning surfaces in the cover according to the present invention. In the present invention, the rotary base 51 drives the first conductive sheet 3 to rotate with the second conductive sheet 4 when the rotary shaft 52 is rotated, and the second conductive sheet 4 leaves one of the conductive contact elements 22; the position end 41 of the second conductive sheet 4 is pressed by one positioning surface 72 during the rotation, and the second spring 62 stores energy; the second spring 62 then releases the energy to the fourth end 43 of the second conductive sheet 4, and the position end 41 of the second conductive sheet 4 slides on one positioning surface 72 until the position end 41 of the second conductive sheets 4 is positioned solidly between two positioning surfaces 72.

In FIGS. 8A and 8B, the loading housing 1 also has a plurality of first locking element 14, and the cover 7 has a plurality of second locking element 73. The first locking element 14 locks the second locking element 73 when the loading housing 1 connects with the cover 7. Also refer to FIG. 3, since silver has the highest electrical conductivity, the silver is widely used in electrical contacts and conductors. The conductive element S according to the present invention is disposed on the third end 221 of the conductive contact element 22 and the fourth end 43 of the second conductive sheet 4, and is made by silver. Each conductive element S represents one contact point, in the present invention, the rotary switch only used two contact points in one level, used three contact points in two levels, and used four contact points in three levels.

Figure 9A:
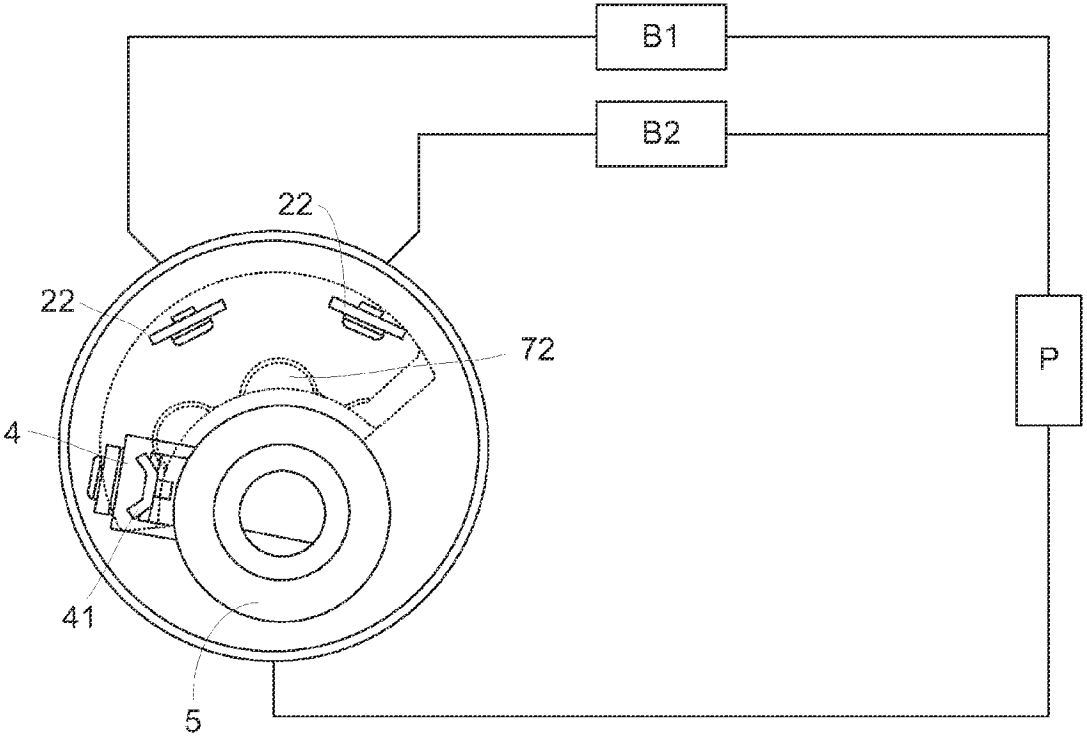
FIGS. 9A, 9B and 9C demonstrate the switching of three levels rotary switch.
Figure 9B:
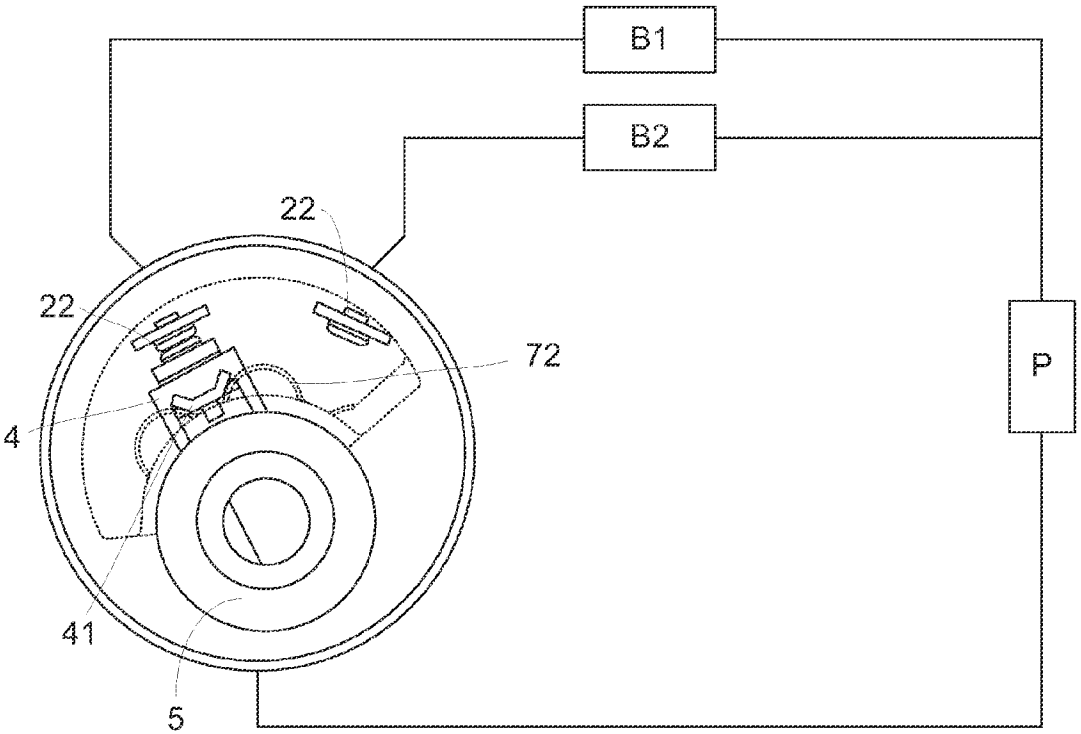
Figure 9C:
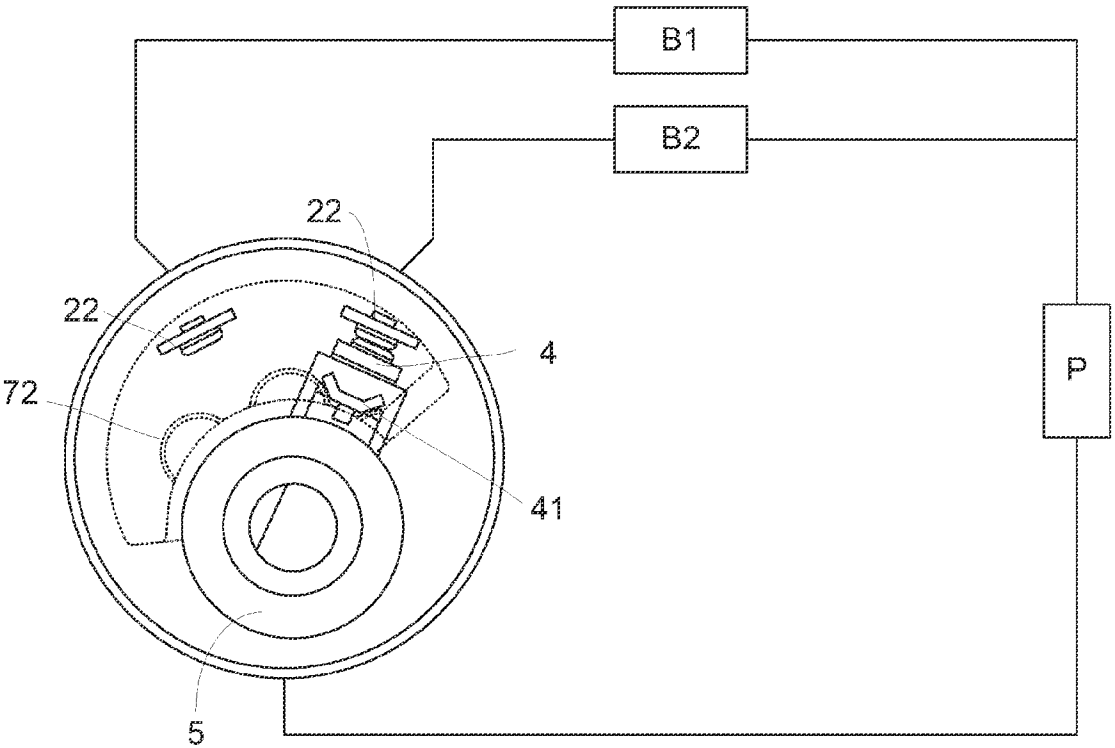

The present invention is multi-level rotary switch, please refer to FIG. 9A to FIG. 9C, which demonstrate the switching of three levels rotary switch, and also refer to FIG. 7. The main contact element 21 of the present invention connects with power supply P, and two conductive contact elements 22 connect with first circuit B1 and second circuit B2 respectively. In FIG. 9A, since the second conductive sheet 4 does not contact with any conductive contact element 22, the first circuit B1 and second circuit B2 do not function. In FIG. 9B, the second conductive sheet 4 contacts with one conductive contact element 22, and the first circuit B1 functions. In FIG. 9C, the second conductive sheet 4 contacts with another conductive contact element 22, and the second circuit B2 functions. The positioning surfaces 72 are continuous convex surfaces, and the position end 41 of the second conductive sheets 4 is positioned solidly between continuous convex surfaces. From above description, two conductive contact elements 22 are able to connect with different electrical products, and the rotary switch of the present invention can switch electrical product to function. So that, this implementation manner of the present invention has three levels including close, first circuit B1 and second circuit B2. According to the implementation manner provided by the present invention, for multi-level rotary switch, designer adds one contact point in each level of the rotary switch increasing.

Figure 10:
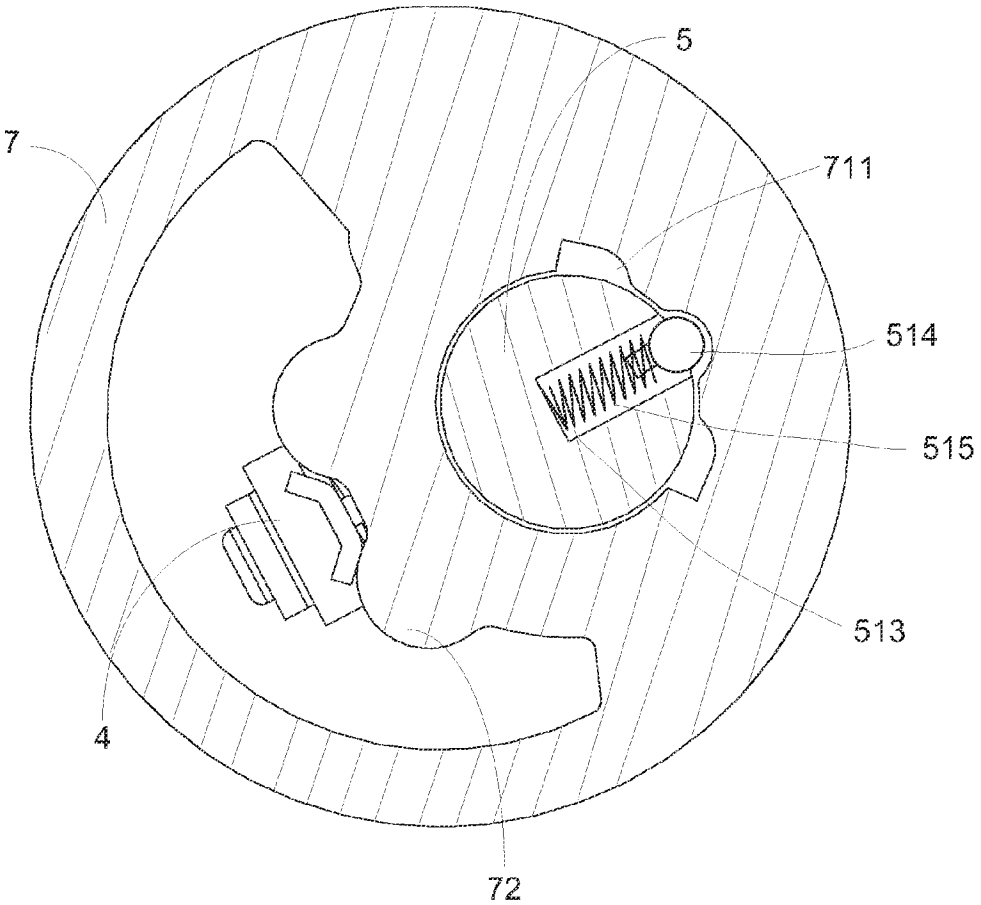
FIG. 10 is a sectional view of rotary body and cover according to the present invention.

The present invention provides another implementation manner to increase clap effect, please refer to FIG. 10, shown a sectional view of rotary body and cover according to the present invention, and also refer to FIG. 5B and FIG. 6. The rotary base 51 further includes a ball accommodating slot 513 to accommodate a rolling ball 514 and an elastic element 515. The rotary body accommodating space 71 of the cover 7 further includes a plurality of ball recess 711, thus, the rolling ball 514 is able to accommodate between the ball recess 711 and the ball accommodating slot 513; the rolling ball 514 moves to location between two ball recess 711 when the rotary shaft 52 is rotated, and the elastic element 515 stores energy; the elastic element 515 then releases the energy to the rolling ball 514 when the rolling ball 514 moves into one ball recess 711, so that, the rolling ball 514 accommodates solidly between the ball recess 711 and the ball accommodating slot 513. In this implementation manner, three ball recesses 711 are formed in the rotary body accommodating space 71.

Figure 11:
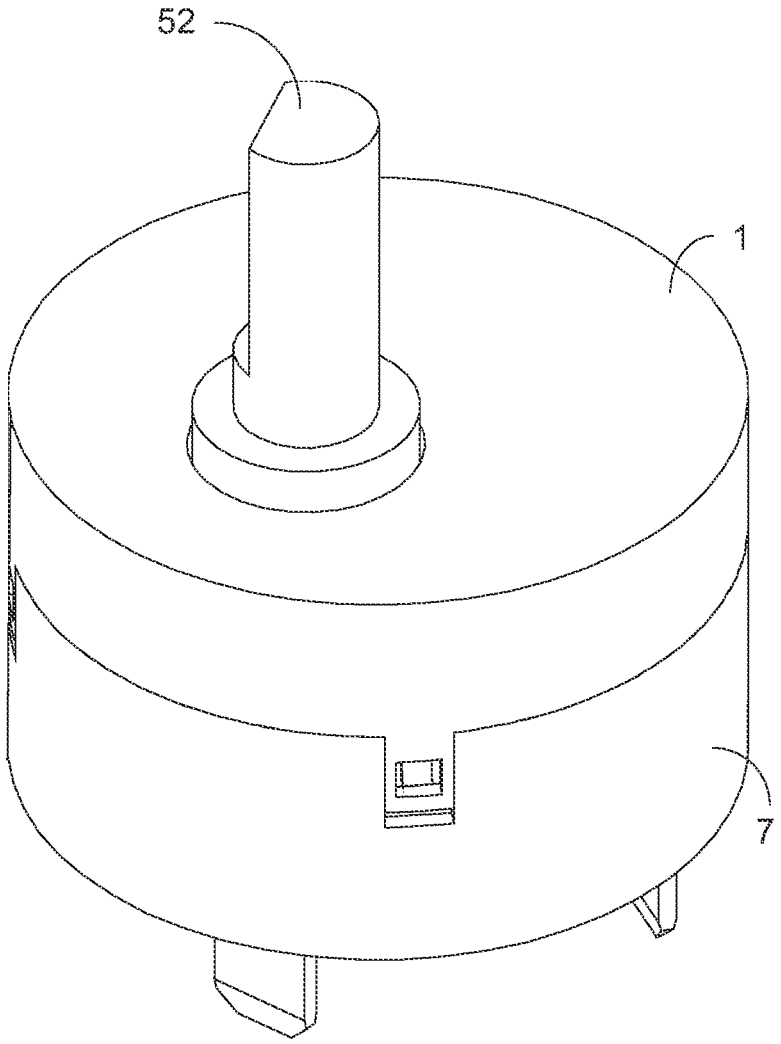
FIG. 11 is a stereo view of the multi-level rotary switch according to the present invention.

Please refer to FIG. 11, shown a stereo view of the multi-level rotary switch according to the present invention, and also refer to FIG. 7. The rotary shaft 52 is out of the cover 7, and designed one plan disposed on a side thereof, for convenient rotation. The rotary shaft 52 is not located at central of the cover 7. This is not intended to limit the scope of the present invention, the length of the first conductive sheet 3 and the second conductive sheet 4 represent momentum arm, the momentum arm can be adjusted according necessity, so as the positioning surface 72, thus, the rotary shaft 52 might be located at central of the cover 7.

Therefore, the above descriptions have been clearly and completely introduced the multi-level rotary switch of the present invention; in summary, the present invention has the following advantages:

1. lower the usage of conductive element: in conventional rotary switch, each level requests four contact points. In the present invention, the rotary switch only used two contact points in one level, the circuit is available. Moreover, in conventional rotary switch, each level needs to add two contact points as increasing. In the present invention, only adds one contact point in each level of the rotary switch increasing. So that, the present invention requests less contact point to the conventional rotary switch as level increasing, and the usage of conductive element can be saved.

2. elastic increasing: the first spring is disposed between the first pressing portion of the first conductive sheet and the elastic element accommodating slot, to secure the first pressing portion pressing on the first end of the main contact element, and avoid conductive sheet fail from fatigue for a period. Moreover, the second spring is disposed between the second pressing portion and the fourth end of the second conductive sheet, to secure the fourth end of the second conductive sheet pressing on the first end of the main contact element.

3. break away easily: during the switching of the conventional rotary switch, electric circuit flows through conductive elements, and electric arc issues after conductive elements breaking away, thus the temperature is easily out of control by time, then conductive elements stick each other, the conventional rotary switch cannot switch anymore. However, in the present invention, momentum arm can transfer momentum, and the positioning surfaces provide pushing, thus, conductive elements can break away easily, keep the function of the rotary switch of the present invention.

The above description is made on embodiments of the present invention. However, the embodiments are not intended to limit scope of the present invention, and all equivalent implementations or alterations within the spirit of the present invention still fall within the scope of the present invention.

We claim:

1. A multi-level rotary switch, comprising:

a loading housing, having an accommodating space, and a first inserting hole being formed below the accommodating space with a plurality of second inserting holes;

a plurality of contact elements, being connected with any circuit, and further comprising:

a main contact element, having a first end and a second end, wherein the first end is located and flatted in the accommodating space, and the second end passes through the first inserting hole of the loading housing;

a plurality of conductive contact elements, passing through the second inserting holes of the loading housing; wherein each conductive contact element has a third end; wherein the third end is in the accommodating space with one conductive element;

a first conductive sheet, having an inserting end, a first pressing portion, a second pressing portion and a sheet accommodating opening; wherein the first pressing portion is between the inserting end and the second pressing portion, and disposed on the first end of the main contact element; wherein the sheet accommodating opening is located at the second pressing portion with a piercing unit;

a second conductive sheet, having a position end, a piercing hole, a fourth end; wherein the position end with curved shape passes through and locates above the sheet accommodating opening; the piercing hole is between the position end and the fourth end, and is inserted by the piercing unit, so that, the second conductive sheet is locked with the first conductive sheet; wherein the fourth end has one conductive element, and contacts with at least one conductive element disposed on the third end of one of the plurality of conductive contact elements;

a rotary body, comprising:

a rotary base, having an elastic element accommodating slot and an inserting slot, wherein the inserting end of the first conductive sheet inserts into the inserting slot; and a rotary shaft, being disposed on the rotary base;

a first spring, being located in the elastic element accommodating slot, and leaning against the first pressing portion of the first conductive sheet, thus, the first pressing portion pressing on the first end of the main contact element;

a second spring, leaning against the second pressing portion of the first conductive sheet and the fourth end of the second conductive sheet, thus, the fourth end of the second conductive sheet contacting with the third end of one of the plurality of conductive contact elements; and a cover, being able to combine with the loading housing, having a rotary body accommodating space and a plurality of positioning surfaces; wherein the rotary body passes through the rotary body accommodating space and protrudes out of the cover, thus, the rotary shaft can be operated properly; wherein the positioning surfaces are formed at lower cover, and the position end of the second conductive sheet is able to fit the positioning surfaces, so that the second conductive sheet connected with the first conductive sheet is able to be positioned;

wherein the rotary base drives the first conductive sheet to rotate with the second conductive sheet when the rotary shaft is rotated, and the second conductive sheet leaves one of the conductive contact elements; the position end of the second conductive sheet is pressed by one positioning surface during the rotation, and the second spring stores energy; the second spring then releases the energy to the fourth end of the second conductive sheet, and the position end of the second conductive sheet slides on one positioning surface until the position end of the second conductive sheets is positioned solidly between two positioning surfaces.

2. The multi-level rotary switch of claim 1, wherein the conductive elements are disposed on the third end of the conductive contact element and the fourth end of the second conductive sheet, and are made by the material consisting of: silver and aluminum.

3. The multi-level rotary switch of claim 1, wherein the rotary base further includes a ball accommodating slot to accommodate a rolling ball and an elastic element.

4. The multi-level rotary switch of claim 3, wherein the rotary body accommodating space of the cover further includes a plurality of ball recess, thus, the rolling ball is able to accommodate between the ball recess and the ball accommodating slot; the rolling ball moves to location between two ball recess when the rotary shaft is rotated, and the elastic element stores energy; the elastic element then releases the energy to the rolling ball when the rolling ball moves into one ball recess, so that, the rolling ball accommodates solidly between the ball recess and the ball accommodating slot.

5. The multi-level rotary switch of claim 3, wherein the positioning surfaces are continuous convex surfaces, and the position end of the second conductive sheets is positioned solidly between continuous convex surfaces.

* * * * *